US006295706B1

(12) United States Patent
Strahm

(10) Patent No.: US 6,295,706 B1
(45) Date of Patent: Oct. 2, 2001

(54) METHOD AND DEVICE FOR FIBRILLATING A STRIP-LIKE FLAT TEXTILE STRUCTURE BY SUBJECTING IT TO A HIGH-PRESSURE LIQUID

(75) Inventor: Christian Strahm, Bronschhofen (CH)

(73) Assignee: Solipat AG, Chamerstrasse (CH)

( * ) Notice: Subject to any disclaimer, the term of this patent is extended or adjusted under 35 U.S.C. 154(b) by 0 days.

(21) Appl. No.: 09/622,051

(22) PCT Filed: Feb. 11, 1999

(86) PCT No.: PCT/EP99/00884

§ 371 Date: Nov. 14, 2000

§ 102(e) Date: Nov. 14, 2000

(87) PCT Pub. No.: WO99/43881

PCT Pub. Date: Sep. 2, 1999

(30) Foreign Application Priority Data

Feb. 24, 1998 (EP) ..... 98810147

(51) Int. Cl.[7] ..... D06C 19/00; D04H 1/46

(52) U.S. Cl. ..... 28/167; 28/104

(58) Field of Search ..... 28/167, 104, 105, 28/106, 163; 68/205 R, 201

(56) References Cited

U.S. PATENT DOCUMENTS

| | | | | |
|---|---|---|---|---|
| 3,751,777 | * | 8/1973 | Turmel et al. | 28/167 |
| 4,085,485 | * | 4/1978 | Brandon et al. | 28/104 |
| 4,152,480 | | 5/1979 | Adachi et al. . | |
| 4,805,275 | * | 2/1989 | Suzuki et al. | 28/104 |
| 5,737,813 | * | 4/1998 | Sternlieb et al. | 28/167 |
| 5,806,155 | * | 9/1998 | Malaney et al. | 28/167 |
| 5,870,807 | * | 2/1999 | Beaty | 28/167 |
| 5,983,469 | * | 11/1999 | Beaty et al. | 28/167 |

FOREIGN PATENT DOCUMENTS

97/19213 5/1997 (WO) .

* cited by examiner

*Primary Examiner*—Amy B. Vanatta
(74) *Attorney, Agent, or Firm*—Shoemaker and Mattare, Ltd.

(57) ABSTRACT

For fibrillating a continuously conveyed, textile sheet material (3) a fluid under high pressure is delivered through a wide-slot nozzle (6) as a continuous fluid curtain (14) onto the sheet material (3). With this gentle way of fibrillating all types of fabrics may be fibrillated, in particular also light materials. The wide-slot nozzle (6) can be manufactured simply and inexpensively.

18 Claims, 3 Drawing Sheets

Figure 1:
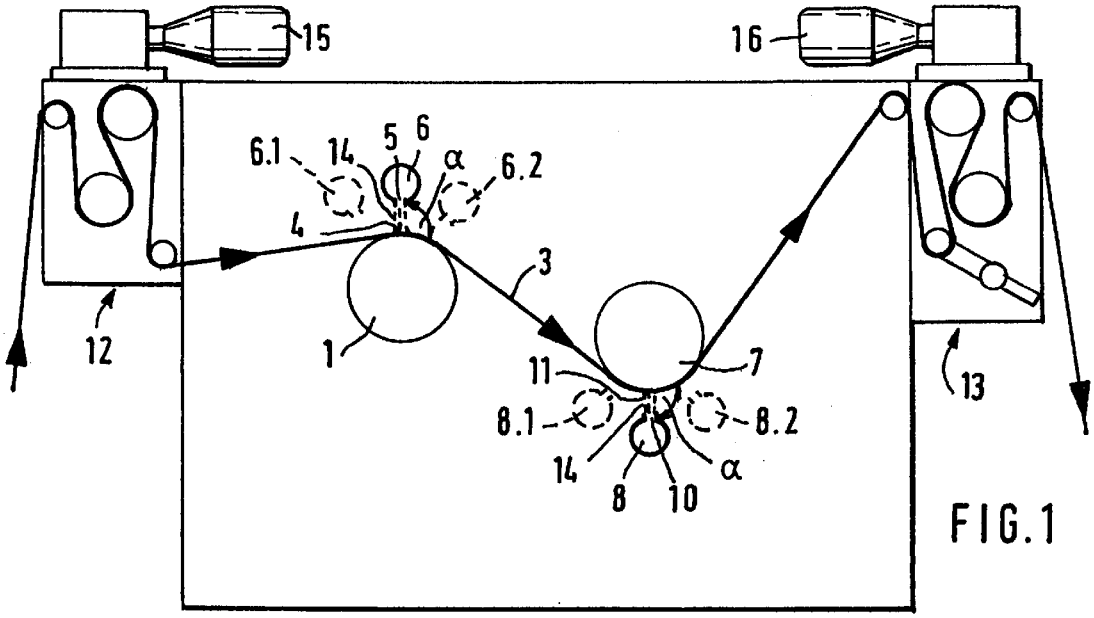

METHOD AND DEVICE FOR FIBRILLATING A STRIP-LIKE FLAT TEXTILE STRUCTURE BY SUBJECTING IT TO A HIGH-PRESSURE LIQUID

The invention relates to a method and a device for fibrillating a web-like, textile sheet material. It thus belongs very generally to the field of textile finishing.

With the term "fibrillating" the production of short fibre pieces, so-called micro-fibres, on the surface of the fibres constituting the sheet material is described. The micro-fibrils are the result of mechanical, enzymatic and/or chemical treatment of the textile sheet material. By way of this a "silk-like" feel is achieved. The "peach skin" or "patina" which thus arises gives the sheet material an improved drape and look. For fibrillating textile sheet material various methods and devices are known, e.g. with the aid of granular grinding means, such as sand paper or diamond paper, or by way of rotating brushes.

One method for fibrillating by way of impacting the textile sheet material with high pressure fluid is the subject-matter of WO97/19213. With this high pressure fluid exits a multitude of closely placed openings onto the continuously conveyed textile material sheet. The manufacture of a nozzle with such openings is complicated. Furthermore the small diameter of the openings and their small mutual distance lead to a blocking of the bores by way of deposits of dissolve salts and contaminants in the high pressure fluid. The fluid jets separated from one another exiting the openings may furthermore lead to an irregular, stripe-like fibrillation of the web-like textile sheet material.

It is therefore the object of the present invention to make available a method and a device for fibrillating web-like textile sheet material by way of impacting with high pressure fluid, which avoid the disadvantages of that which exists.

In the document U.S. Pat. No. 4,152,480 there is described a method in which a continuously conveyed, web-like textile sheet material is impacted with high pressure fluid delivered through a wide-slot nozzle. By way of this the individual fibres of the textile sheet material are to be intertwined or matted with one another in order to produce a fleece-like product.

A similar method with a wide-slot nozzle may also be applied for fibrillating a textile sheet material if the fluid is led to the wide-slot nozzle through a supply conduit whose cross section is considerably larger that the complete area of the free passage opening of the exit gap of the wideslot nozzle.

The method according to the invention and the device according to the invention, with which the set object is to be achieved, are defined in the independent patent claims.

The device according to the invention and the method according to the invention are suitable for all types of textile fibres, or for the textile sheet material manufactured therefrom, preferably for the fibrillation of fine and light fabrics in a gentle manner.

The invention envisages that the high pressure fluid as a continuous fluid curtain impinges over the whole width and on at least one side of the continuously conveyed textile sheet material from the wide-slot nozzle. Such a wide-slot nozzle can be manufactured simply and inexpensively. The shape of the exit gap of the wide-slot nozzle prevents, on account of its larger special dimension and—in comparison discrete bores—its continuous exit opening, a blocking of the high pressure fluid by way of contaminations. A further advantage of the uninterrupted, gap-shaped exit opening lies in an absolutely uniform fluid curtain with which the web-like textile sheet material is impacted. Interruptions in the fluid curtain by way of defects of the nozzles due to design do not occur.

Advantageous fibrillation results are obtained in that the fluid is supplied to the wide-slot nozzle at a pressure of 25 to 70 bar and the running textile sheet material at the impinging location of the fluid is supported by a smooth, preferably impermeable support surface, in particular in the form of a rotatable roller.

The high pressure fluid, by which means the fibrillation is effected, may usefully consist mainly of water, to which if required additional substances may be added. These are to simplify or improve the fibrillation and are preferably swelling agents for cellulose-containing fibres. As such alkaline solutions are particularly suitable, such as e.g. sodium hydroxide, or sodium carbonate solutions. The method according to the invention may be carried out particularly simply when the fluid mixed with air is led to the wide-slot nozzle.

The delivery of a continuous fluid curtain is effected preferably by way of a wide-slot nozzle, whose exit gap for the fluid may be infinitely adjusted in a width between 0.05 mm and 1 mm, preferably from 0.08 mm to 0.15 mm. Also the mounting of the wide-slot nozzle on pivotable arms has shown to be particularly suitable in order to achieve an outstanding fibrillation result. By way of this measure, the angle of impingment, which is spanned between the fluid curtain and the textile sheet material, may thus be infinitely adjusted. The angle may roughly lie in the region of 40° to 150°, preferably 60° to 120°.

The distance between the exit gap of the wide-slot nozzle and the impinging location on the textile sheet material should preferably not exceed 200 mm, advantageously it should not be larger than 150 mm. This is relevant because too large a distance causes pressure losses of the high pressure fluid at the impinging location and by way of this leads to an unsatisfactory fibrillation.

The impacting of the continuously supplied, web-like sheet material may be carried out advantageously when the fluid supply conduit opens into one end of the broad-slot nozzle and to the other end there is connected a return conduit for the fluid. With this connection on both sides, the fluid may be delivered in a circuit, by which means an essentially uniform fluid pressure over the whole length of the broad-slot nozzle may be achieved and any occurring deposits or incrustations may be swept away.

In order to achieve an adequate and uniform supply of fluid and constant fibrillation over the whole gap length, according to the invention the cross section of the supply conduit for the fluid is considerably larger than the total cross section of the exit gap.

By way of these, under all operating conditions always considerably more fluid may be delivered to the wide-slot nozzle than this lets through. Thus the ratio of the area of the tube cross section of the supply conduit of the nozzle to the total area of the passage opening of the exit gap should be at least 30 to 1, preferably 80 upto 100 to 1, or larger. With an exit gap with a total area of 70 $mm^2$ to 400 $mm^2$ from this there results a tube cross section for the supply tube with a total area of at least 2100 $mm^2$ to 40000 $mm^2$.

The device for fibrillating according to the invention comprises further a drive means for guiding the textile sheet material under the wide-slot nozzle and a drive and tensioning device for the further transport of the textile sheet material.

Figure 2:
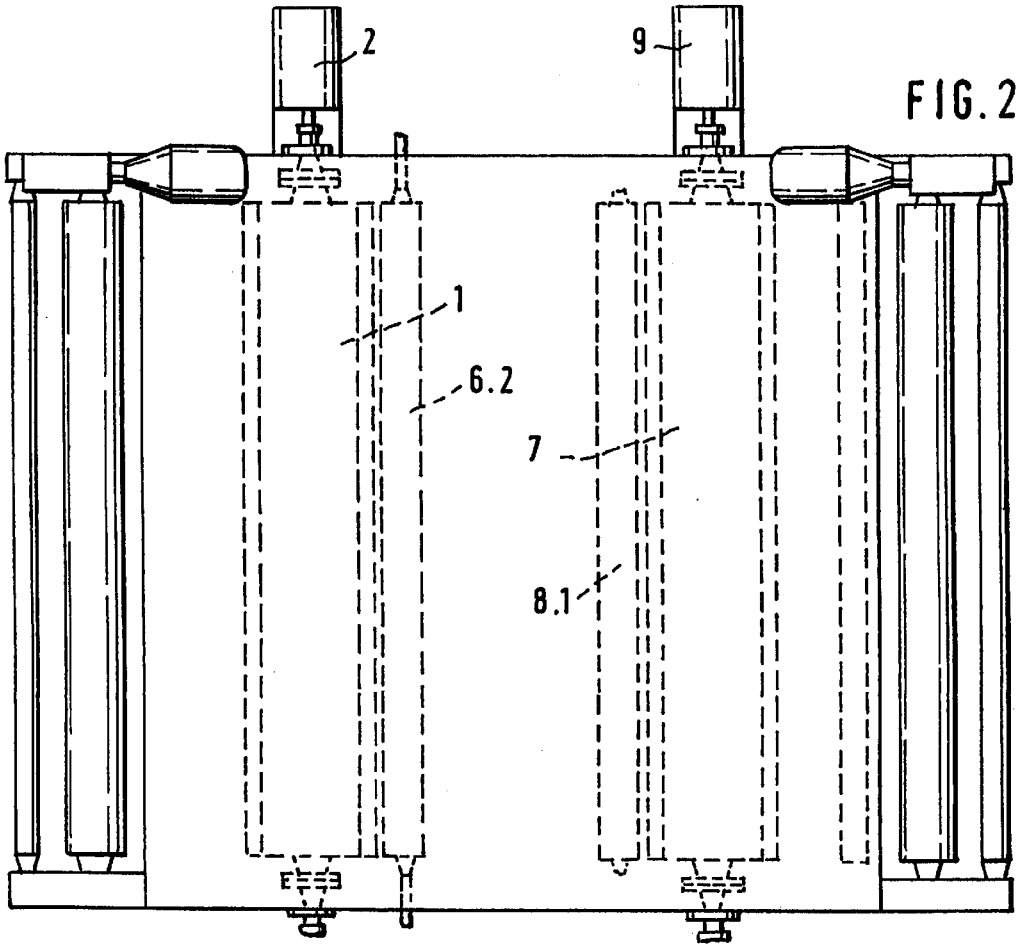
Figure 3:
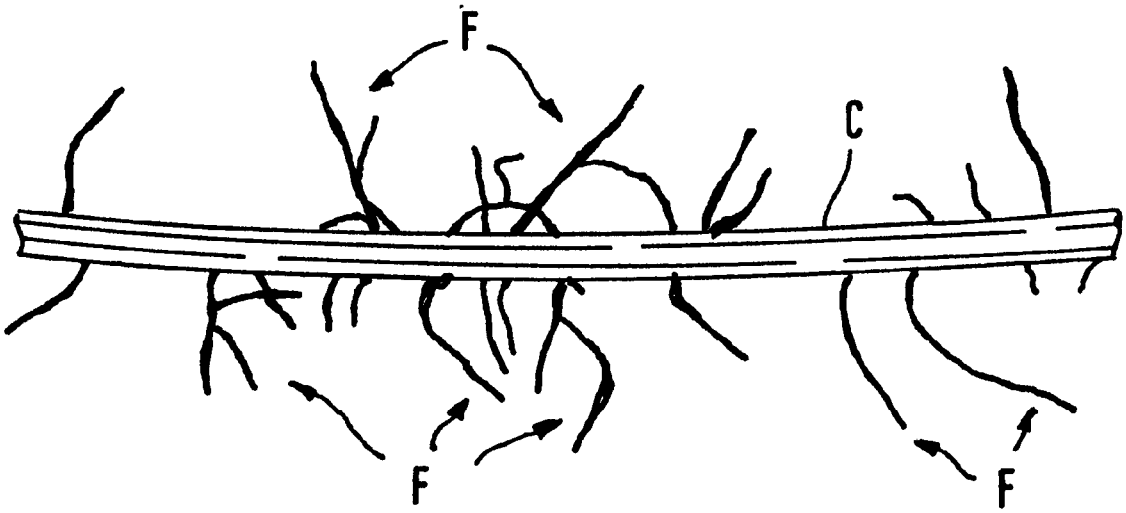
Figure 4:
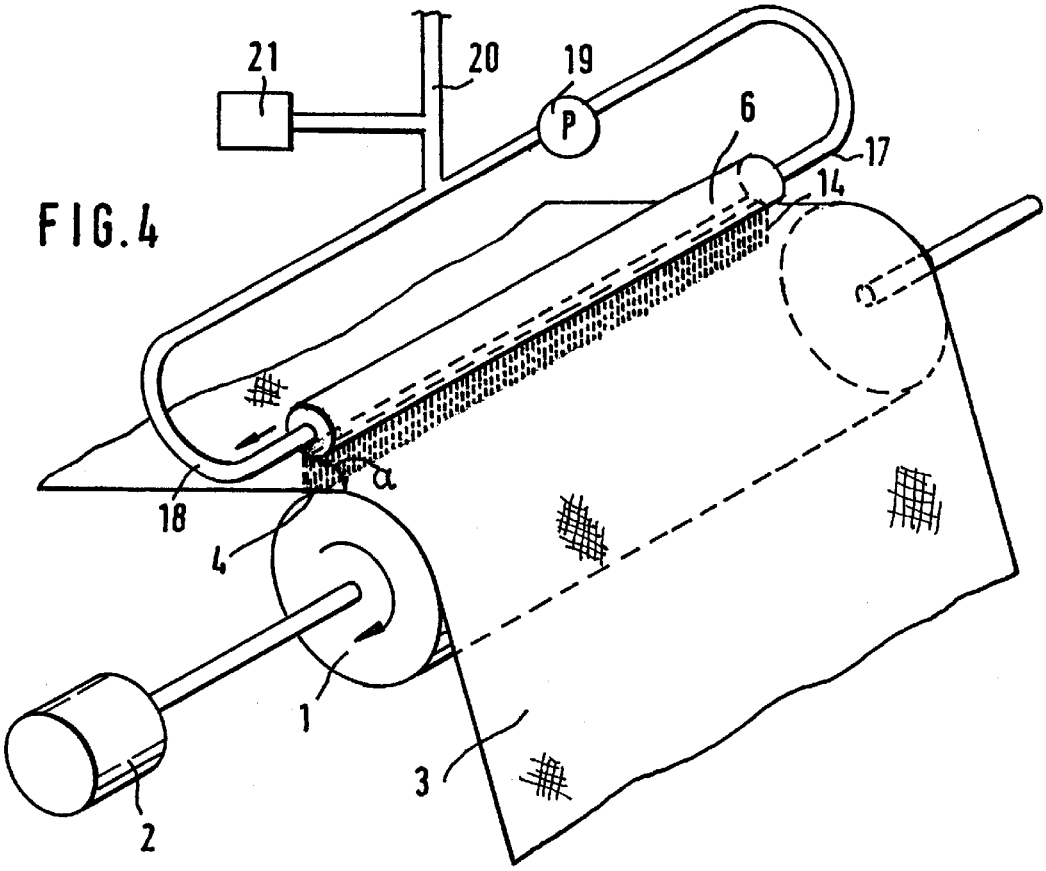
Figure 5:
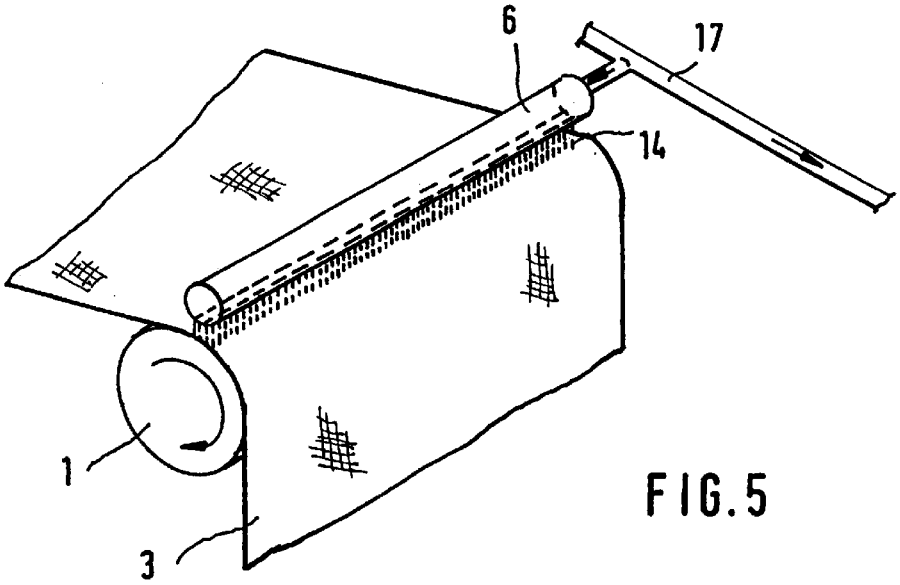

Embodiment examples of the invention are hereinafter described in more detail by way of the drawings. There are shown:

FIG. 1 a schematic vertical section through a machine for fibrillating a web-like, textile sheet material, FIG. 2 a schematic plan view of the machine of FIG. 1, FIG. 3 a schematic representation of a fibrillated fibre, for example a cellulose fibre, FIG. 4 a perspective representation of a wide-slot nozzle operated in a circuit and FIG. 5 a schematic representation of a fibrillating device which is operated with a fluid connection on one side.

The machine represented in FIGS. 1 and 2 contains a rotatable roller 1 with a smooth, impermeable surface which is moved by a drive motor 2. The roller 1 supports and guides a continuously conveyed, web-like, textile sheet material 3, in particular at the impinging location 4 of a high pressure fluid.

The impacting of the continuously conveyed textile sheet material 3 with high pressure fluid is effected as a continuous fluid curtain 14 over the whole width of the material 3 by way of an infinitely adjustable gap 5 of a wide-slot nozzle 6. The width of the gap 5 of the wide-slot nozzle 6 is preferably adjusted in the regions between 0.05 mm and 1 mm. The distance of the wide-slot nozzle 6 to the guide roller 1 as a rule is not more than 20 mm and in this embodiment example is 8 mm. The fluid is supplied to the wide-slot nozzle 6 with a pressure in the region of 25 to 70 bar. The pressure is directed principly to the nature and the transport speed of the textile sheet material 3. The impinging angle $\alpha$ of the fluid onto the sheet material 3, measured between the fluid curtain 14 and the movement direction of the sheet material 3 at the impinging location 4, may usefully be adjustable. The adjustability may be achieved in that the wide-slot nozzle 6 is held on pivoting arms (not represented) which are pivotable about an axis which essentially coincides with the impinging line. By pivoting the arms holding the wide-slot nozzle 6 this may then be adjusted somewhat between a position 6.1—impinging angle $\alpha$ about 120°—and a position 6.2—impinging angle $\alpha$ about 60°. The adjustability of the impinging angle $\alpha$ may however also be achieved in that the roller 1 is mounted on pivoting arms which are pivotable about an axis essentially coinciding with the impinging line 4.

Generally the impinging angle $\alpha$ lies in a region of 40° to 150°, preferably in the region of 60° to 120°.

In the embodiment example at a distance to the rotatable roller 1 there is installed an identical combination of a rotatable roller 7 with a smooth, impermeable surface, which is moved by a drive motor 9, and a wide-slot nozzle 8. Also in this combination the continuously conveyed, textile sheet material 3 however on its opposite side, is impacted at an impinging location 11 with a high pressure fluid curtain 14 which is produced through an infinitely adjustable gap 10 of the wide-slot nozzle 8. Also the wide-slot nozzle 8 may be pivotable between end positions which correspond to an impinging angle $\alpha$ of 120° (position 8.1) and 60° (position 8.2).

Furthermore the machine has means for moving a web-like, textile sheet material 3 into contact with the circumference of the first roller 1 and the second roller 7. To these means there belongs an inlet drive means 12 with conveying rollers drivable by a motor 15. The drive means 12 accommodates the approaching textile sheet material 3 and conveys is broadly over the rotatable rollers 1 and 7. An outlet drive and tensioning means 13 with a drive motor 16 broadly pulls the textile sheet material 3 from the roller 7. The cooperation of the drive means 12 and 13 produces a movement speed of the textile sheet material as a rule between 0 m/min. and 30 m/min., preferably between 5 m/min. and 20 m/min.

The arrangement as is shown, is such that the high pressure fluid curtains 14 exiting from the wide-slot nozzles 6 and 8 impinge in each case on one of the two sides of the running textile sheet material 3 over its whole width and cause fibrillation of the fibres.

The inlet drive means 12 and the outlet drive and tensioning means 13 can be regulated by the man skilled in the art such that in the textile sheet material 3 between the two means 12 and 13 there prevails a tension force which is approximately between 0 and 500 N per cm width of the textile sheet material 3 so that the high pressure fluid produces the desired fibrillation effect.

The positions of the wide-slot nozzles 6 and 8 correspond to the positions 6.2 and 8.1 respectively in FIG. 1.

The high pressure fluid curtain consists as a rule at least for the most part of water. The water may advantageously serve as a carrier for treatment chemicals, in particular for swelling agents, which with natural fibres in particular with cellulose-containing fibre materials enlarge and/or soften the fibre surface. As swelling agents which are present dissolved in the water, for example alkaline solutions (NaOH, sodium carbonate) and alcoholic solutions are to be considered.

In the described manner textile sheet material of all types may be fibrillated—fabrics, knitted fabrics, woven fabrics, nonwoven fabrics, and specifically of natural as well as of synthetic fibres.

FIG. 3 shows schematically a fibrillated cellulose fibre C, which is a components of a textile sheet material which is not shown here and is treated in the described manner. Fibrils F project from the fibre C.

The perspectively represented cutout shown in FIG. 4 and 5 shows the rotary roller 1 with a smooth and impermeable surface, which supports and guides the web-like, textile sheet material 3 and which is driven by a drive motor 2. In the embodiment form as is shown in FIG. 4 the fluid is guided through the wide-slot nozzle 6 in the circuit. A fluid supply conduit 27 in which there is arranged a pump 19 opens into the one end of the wide-slot nozzle 6, and the other end of the wide-slot nozzle 6 is connected to a return conduit 18. The supply and removal conduits 17 and 18 have a diameter range of DN 20 mm to DN 200 mm, and thus a passage area of 300 $mm^2$ to 30000 $mm^2$. The ratio of the total area of the passage opening of the supply conduit 17 to the passage area of the wide-slot nozzle 6 is thus about 100:1. (The total area of the passage opening is computed from the length of the opening multiplied by the width of the opening at the narrowest location of the nozzle cross section).

The pump with a delivery output of 750 l/min ensures that an adequate fluid quantity is delivered and impacts on the impinging location 4. The pump 19 serves the pumping around of the fluid in the circuit. As a fluid water is used which is supplied through a conduit 20. To the conduit 20 there is connected a metering means 21 which meters additional substances and/or air to the supplied water.

In FIG. 5 the wide-slot nozzle 6 with a fluid supply 17 on only one side is shown. The high pressure fluid is in this case not pumped in the circuit.

What is claimed is:

1. A method for fibrillating a continuously conveyed textile web, said method comprising steps of delivering a continuous curtain of fluid against the entire width of at least one side of the textile web by means of a wide-slot nozzle having an exit gap, and supplying said fluid to the wide-slot nozzle via a supply conduit whose cross-section is equal to 300 to 100 times the total area of the area of the exit gap of the wide-slot nozzle.

2. A method according to claim 1, wherein the fluid is supplied to the wide-slot nozzle at a pressure of 25 to 70 bar.

3. A method according to claim 1, wherein the web is supported by a smooth, impermeable support surface where it is impinged by said fluid.

4. A method according to claim 1, wherein the wide-slot nozzle has a fluid connection on both its lateral sides.

5. A method according to claim 1, wherein the distance between the exit gap of the wide-slot nozzle and the textile web is not more than 20 mm.

6. A method according to claim 1, wherein the fluid consists essentially of water.

7. A method according to claim 1, wherein the fluid consists of water and swelling agents for natural fibers.

8. A method according to claim 1, wherein the fluid is directed at the web at an impinging angle of between 40° and 150°.

9. A method according to claim 1, wherein the fluid is mixed with air before it is supplied to the wide-slot nozzle.

10. A device for fibrillating a textile web by means of a high-pressure fluid, said device comprising means for continuously conveying the web, a wide-slot nozzle for delivering a continuous fluid curtain onto the web and a supply conduit for supplying said fluid to the wide-slot nozzle, wherein the supply conduit has a cross-section area 30 to 100 times the free passage opening of the exit gap of the wide-slot nozzle.

11. A device according to claim 10, wherein the supply conduit has a cross-section which is equal to 80 to 100 times the total area of the free passage opening of the exit gap of the wide-slot nozzle.

12. A device according to claim 10, wherein the total area of the free passage opening of the exit gap is between 70 $mm^2$ and 400 $mm^2$ and the cross-sectional area of the supply conduit is between 2100 $mm^2$ and 40000 $mm^2$.

13. A device according to claim 10, further comprising a rotatable roller having a smooth, impermeable surface for supporting and guiding the web wherein it is impinged by the liquid.

14. A device according to claim 10, wherein the web conveying means includes a drive means for guiding the web past the wide-slot nozzle and a drive and tensioning means for further transporting the textile web.

15. A device according to claim 10, further comprising means for continuously adjusting the width of the exit gap of the wide-slot nozzle.

16. A device according to claim 10, further comprising pivotable arms supporting the wide-slot nozzle in such a way that the impinging angle of the fluid against the web is continuously adjustable in the range of 60° to 120°.

17. A device according to claim 10, wherein the fluid supply conduit opens into one end of the wide-slot nozzle and further comprising a return conduit attached to the other end of the nozzle.

18. A device according to claim 10, further comprising means for metering additional substances into the high pressure fluid supplied to the wide-slot nozzle.

* * * * *

UNITED STATES PATENT AND TRADEMARK OFFICE

CERTIFICATE OF CORRECTION

PATENT NO. : 6,295,706 B1
DATED : October 2, 2001
INVENTOR(S) : Strahm

It is certified that error appears in the above-identified patent and that said Letters Patent is hereby corrected as shown below:

Column 4,
Line 65, "300" should read -- 30 --

Signed and Sealed this

Thirtieth Day of April, 2002

*Attest:*

*Attesting Officer*

JAMES E. ROGAN
*Director of the United States Patent and Trademark Office*